US006493525B2

(12) United States Patent
Nakamura et al.

(10) Patent No.: US 6,493,525 B2
(45) Date of Patent: Dec. 10, 2002

(54) IMAGE FORMING APPARATUS

(75) Inventors: Sotaro Nakamura, Kanagawa (JP); Takanobu Saitoh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 09/854,598

(22) Filed: May 15, 2001

(65) Prior Publication Data

US 2002/0012543 A1 Jan. 31, 2002

(30) Foreign Application Priority Data

May 19, 2000 (JP) ..... 2000-147423
Apr. 19, 2001 (JP) ..... 2001-121582

(51) Int. Cl.[7] ..... G03G 15/20

(52) U.S. Cl. ..... 399/69; 399/45; 399/92; 399/94

(58) Field of Search ..... 399/44, 45, 67, 399/69, 92, 94

(56) References Cited

FOREIGN PATENT DOCUMENTS

| | | | |
|---|---|---|---|
| JP | 60-22155 | | 2/1985 |
| JP | 3-142482 | * | 6/1991 |
| JP | 4-134459 | * | 5/1992 |
| JP | 6-332330 | | 12/1994 |
| JP | 7-319370 | | 12/1995 |
| JP | 9-197922 | * | 7/1997 |
| JP | 9-244517 | | 9/1997 |
| JP | 9-297495 | | 11/1997 |
| JP | 11-212433 | * | 8/1999 |
| JP | 2000-181275 | * | 6/2000 |
| JP | 2000-259045 | | 9/2000 |
| JP | 2001-92304 | * | 4/2001 |
| JP | 2001-242745 | * | 9/2001 |
| JP | 2001-242768 | * | 9/2001 |

OTHER PUBLICATIONS

Patent Abstracts of Japan, JP 03 063673, Mar. 19, 1991.
Patent Abstracts of Japan, JP 09 062168, Mar. 7, 1997.
Patent Abstracts of Japan, JP 08 211763, Aug. 20, 1996.
Patent Abstracts of Japan, JP 05323754, Dec. 7, 1993.
Patent Abstracts of Japan, JP 02 022676, Jan. 25, 1990.
Patent Abstracts of Japan, JP 05 216320, Aug. 27, 1993.

* cited by examiner

*Primary Examiner*—Quana M. Grainger
(74) *Attorney, Agent, or Firm*—Oblon, Spivak, McClelland, Maier & Neustadt, P.C.

(57) ABSTRACT

An image forming apparatus of the present invention is capable of protecting a sheet or recording medium from defective fixation and creases and enhancing image quality. These advantages are achievable even when the operator of the apparatus switches the kind of sheets to use or selects, e.g., a special sheet needing a particular fixing condition.

8 Claims, 8 Drawing Sheets

FIG. 7

| CONDITION INPUT ON CONTROL PANEL | OPERATION OF FAN UP TO SHEET FEED START | FAN ROTATION AFTER SHEET FEED START |
|---|---|---|
| (1) ORDINARY ⟶ THIN | HIGH SPEED ROTATION | STOP |
| (2) THIN ⟶ ORDINARY | STOP | CONTINUE |
| (3) 1200dpi → 600dpi | STOP FOR A PRESELECTED PERIOD OF TIME | CONTNUE |
| (4) 600dpi → 1200dpi | HIGH SPEED ROTATION FOR A PRESELECTED PERIOD OF TIME | STOP |
| (5) ORDINARY ⟶ THIN<br>(1200dpi) (600dpi)<br>130°C 170°C | STOP<br>TEMPERATURE RISE BY 40°C | STOP |
| (6) ORDINARY ⟶ THIN<br>(600dpi) (1200dpi)<br>175°C 150°C | HIGH SPEED ROTATION FAN A PRESELECTED PERIOD OF TIME<br>TEMPERATURE DROP BY 25°C | STOP |
| (7) THIN ⟶ ORDINARY<br>(1200dpi) (600dpi)<br>120°C 180°C | STOP<br>TEMPERATURE RISE BY 60°C | CONTINUE |
| (8) THIN ⟶ ORDINARY<br>(600dpi) (1200dpi)<br>165°C 160°C | USUAL ROTATION<br>TEMPERATURE DROP BY 5°C | STOP |

FIG. 8A

| FIXING TEMPERATURE IN SHEET FEED MODE | | |
|---|---|---|
| THIN SHEET (1,200dpi) ≦ ORDINARY SHEET (1,200dpi) | THIN SHEET (600dpi) ≦ ORDINARY SHEET (600dpi) | |
| (150°C) | (160°C) | (170°C) | (180°C) |

FIG. 8B

| FIXING TEMPERATURE IN STANDBY MODE | | |
|---|---|---|
| THIN SHEET (1,200dpi) ≦ ORDINARY SHEET (1,200dpi) | THIN SHEET (600dpi) ≦ ORDINARY SHEET (600dpi) | |
| (120°C) | (130°C) | (165°C) | (175°C) |

IMAGE FORMING APPARATUS

BACKGROUND OF THE INVENTION

The present invention relates to a copier, printer, facsimile apparatus or similar electrophotographic image forming apparatus.

Generally, an image forming apparatus includes a photoconductive element, an exposing unit, a developing unit, an image transferring unit, a fixing unit, a cleaning unit, a sheet feeder, a registration roller pair, an outlet roller, and an outlet sensor. The apparatus additionally includes a heat discharge fan for discharging heat generated in the apparatus, e.g., heat generated by the fixing unit.

Assume that the image forming apparatus forms an image with high resolution based on a low linear velocity, and that the heat discharge fan continuously rotates from the time when a sheet starts being driven by the registration roller pair to the time when it moves away from the outlet sensor. Then, when the leading edge of the sheet passes the outlet sensor, a stream of air generated by the heat discharge fan is apt to cause the leading edge to shake and therefore crease, degrading image quality. A thin sheet, in particular, cannot smoothly enter the fixing unit due to the influence of the stream of air and therefore creases.

Japanese Patent Laid-Open Publication No. 7-319370, for example, teaches countermeasures against the creasing of a sheet ascribable to the heat discharge fan. In accordance with this document, when use is made of a thin sheet, a heat discharge fan is rotated at a lower speed than usual. At the same time, a control member adjoining the heat discharge fan for controlling airflow is replaced with one having a smaller air passage in order to reduce airflow. Further, a motor drives the control member in order to vary its angular position, thereby reducing the airflow of the heat discharge fan.

There is an increasing demand for an image forming apparatus capable of printing images with a plurality of different resolutions and thereby enhancing image quality. An image forming apparatus with this capability may be constructed to feed, for resolution as low as 600 dpi (dots per inch), a sheet at a usual linear velocity or feed, for resolution as high as 1,200 dpi, a sheet by reducing the usual linear velocity to one half.

Laid-Open Publication No. 7-319370 mentioned earlier does not control the rotation speed of the heat discharge fan in accordance with resolution. As a result, when a sheet is fed at the lower linear velocity for the resolution of 1,200 dpi, the stream of air generated by the fan is apt to cause the leading edge of the sheet to shake and crease. We have proposed an implementation for protecting a sheet fed at the lower linear velocity or a thin sheet from creases ascribable to the heat discharge fan. The implementation consists in stopping the rotation of the heat discharge fan from the time when a registration roller pair starts driving the sheet to the time when the leading edge of the sheet moves away from an outlet sensor.

Some problems arise when images with different resolutions are continuously printed on consecutive sheets. For example, assume that a first sheet is conveyed at the higher linear velocity for the lower resolution or is implemented by an ordinary sheet, and then a second sheet is conveyed at the lower linear velocity for the higher resolution or is implemented by a thin sheet. Then, high fixing temperature is assigned to the first sheet. Despite that lower target fixing temperature is assigned to the second sheet that immediately follows the first sheet, the temperature cannot be lowered to the target temperature and causes the second sheet to crease.

Also, assume that a first sheet is conveyed at the lower linear velocity or is implemented by a thin sheet, and then a second sheet is conveyed at the higher linear velocity or is implemented by a usual sheet. Despite that the higher target fixing temperature is assigned to the second sheet that immediately follows the first sheet, the temperature cannot be raised to the target temperature and fails to fully fix toner on the second sheet. In this manner, when different resolutions and different kinds of sheets are dealt with together, sheet feed occurs before the fixing temperature reaches the target temperature. This makes it impossible to fully protect sheets from creases and other defects.

Technologies relating to the present invention are also disclosed in, e.g., Japanese Patent Laid-Open Publication Nos. 6-332330 and 2000-259045.

SUMMARY OF THE INVENTION

It is therefore an object of the present invention to provide an image forming apparatus capable of protecting a sheet from defective fixation and creases and enhancing image quality even when the kind of sheets to be used is varied or when a special sheet, for example, needing a particular fixing condition is selected.

BRIEF DESCRIPTION OF THE DRAWINGS

The above and other objects, features and advantages of the present invention will become more apparent from the following detailed description taken with the accompanying drawings in which:

FIG. 7 is a table listing a relation between conditions selected on a control panel included in the illustrative embodiment and the operation of a heat discharge fan also included in the illustrative embodiment;

FIGS. 8A and 8B are tables listing experimental data relating to the temporary stop of rotation of the heat discharge fan.

DESCRIPTION OF THE PREFERRED EMBODIMENT

Figure 1:
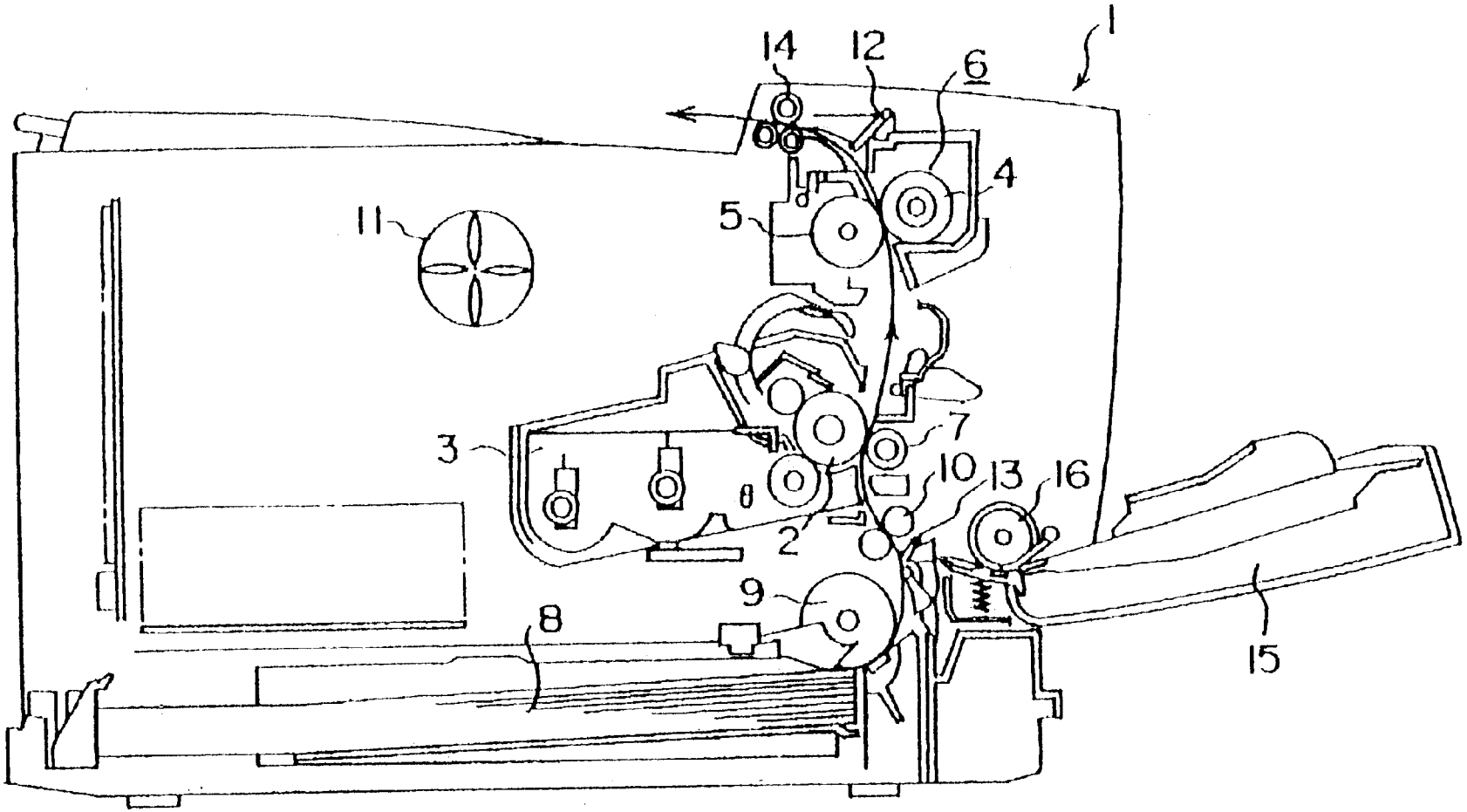
FIG. 1 is a view showing an image forming apparatus embodying the present invention.

Referring to FIG. 1 of the drawings, an image forming apparatus embodying the present invention is shown and generally designated by the reference numeral 1. As shown, the image forming apparatus 1 includes a photoconductive element implemented as a drum 2. A developing unit 3 and an image transfer roller 7 adjoin the drum 2. A fixing unit 6 includes a heat roller 4 and a press roller 5. While the drum 2 is in rotation, a charger, not shown, uniformly charges the surface of the drum 2. A latent image is electrostatically formed on the charged surface of the drum 2 in accordance with image data representative of a document image. The developing unit 3 develops the latent image with a developer or toner to thereby produce a corresponding toner image. A cassette or sheet feeder 8 is removably positioned in the lower portion of the apparatus 1 and loaded with a stack of sheets. A pickup roller 9 pays out the top sheet from the cassette 8 toward a registration roller pair 10. The registration roller pair 10 drives the sheet at such timing that the leading edge of the sheet meets the leading edge of the toner image. The image transfer roller 7 transfers the toner image from the drum 2 to the sheet.

More specifically, the registration roller pair 10 once stops the movement of the sheet and again drives it toward the image transfer roller 7 at the above-mentioned timing. A controller 27 (see FIG. 2) causes the registration roller pair 10 to so operate by sending a drive start signal thereto. A registration sensor 13 senses the sheet arrived at the registration roller pair 10.

The fixing unit 6 fixes the toner image carried on the sheet with heat and pressure. An outlet roller 14 delivers the sheet with the fixed image, i.e., a copy to the outside of the apparatus 1. At this instant, an outlet sensor 12 senses the sheet and causes its output to go high.

A manual sheet feed section 15 allows the operator of the apparatus 1 to feed an OHP (OverHead Projector) sheet, thick sheet or similar special sheet by hand. A pickup roller 16 delivers such a special sheet from the manual sheet feed section 15 to the registration roller pair 10. The registration roller pair 10 drives the special sheet toward the image transfer roller 7 in the same manner as it drives the usual sheet paid out from the cassette 8. A heat discharge fan 11 discharges heat generated inside the apparatus 1, e.g., heat generated by the fixing unit 6 to the outside of the apparatus 1.

The illustrative embodiment is characterized in that when the kind of sheets to be used or resolution is varied, the controller 11 controls the rotation of the heat discharge fan 11 in order to protect the sheets from creases, which are ascribable to an air stream generated by the fan 11.

Figure 2:
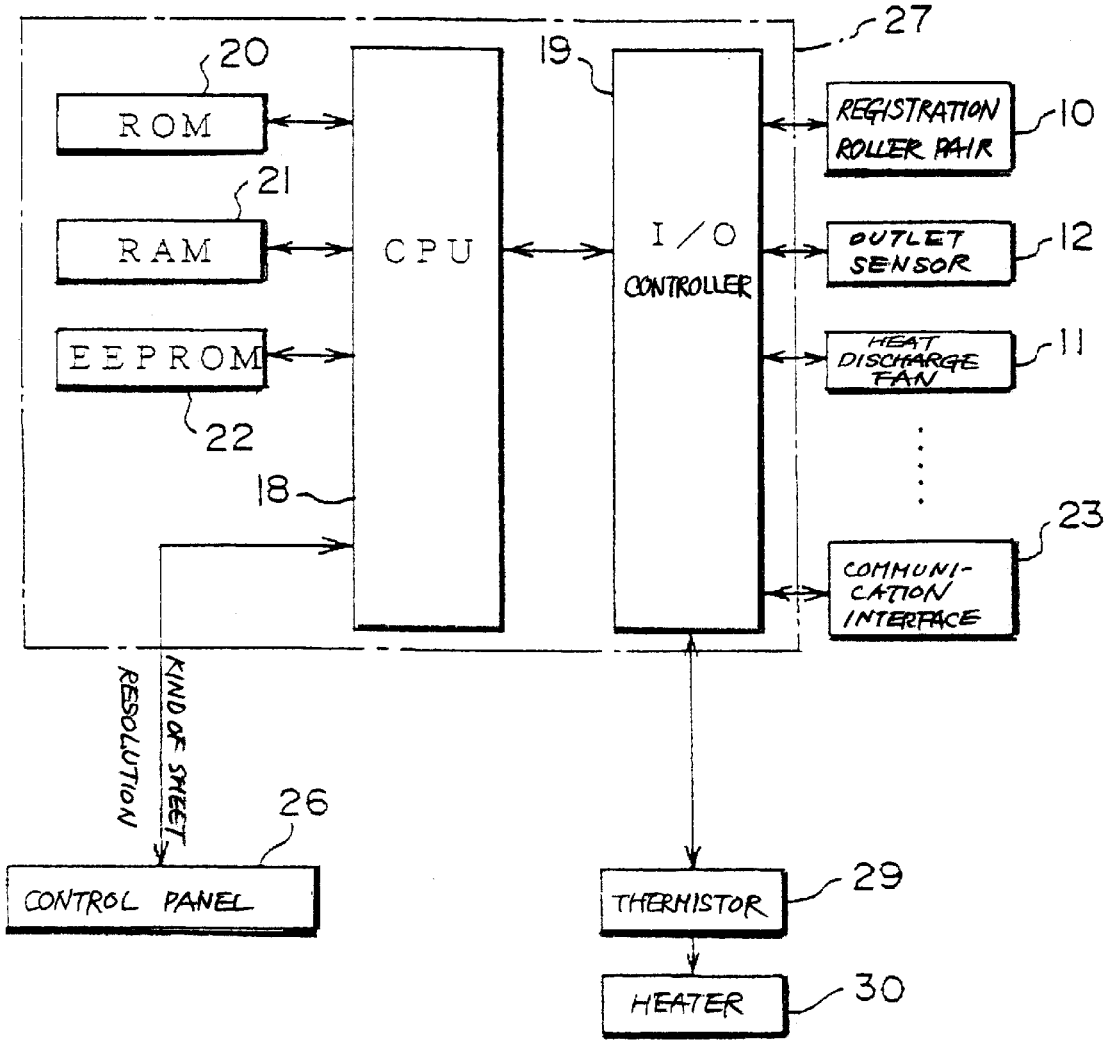
FIG. 2 is a schematic block diagram showing a control system included in the illustrative embodiment.

Specifically, as shown in FIG. 2, the controller or engine 27 includes a CPU (Central Processing Unit) 18, an I/O (Input/Output) controller 19, a ROM (Read Only Memory) 20, a RAM (Random Access Memory) 21, and an EEPROM (Electrically Erasable Programmable ROM) 22. The ROM 20 stores a program, i.e., commands meant for the CPU 18. The RAM 21 serves as a volatile memory when the control program is being executed. In the illustrative embodiment, the controller 27 temporarily stops the operation of the heat discharge fan 11 or switches it in accordance with the kind of sheets to be used or resolution. Further, the controller 27 selectively raises or lowers fixing temperature in a sheet feed mode or a standby mode in accordance with a fixation control program installed in the controller 27, as will be described specifically later.

The EEPROM 22 is a nonvolatile memory for storing data that should be preserved even when a power switch, not shown, is turned off, e.g., the contents of counters for maintenance. Just after the turn-on of the power switch, the CPU 18 reads the control program out of the ROM 22 and delivers commands to the RAM 21 and EEPROM 22. The registration roller pair 10, outlet sensor 12, heat discharge fan 11 and other mechanical sections and the CPU 18 interchange information via the I/O controller 19. A heater 30 and a thermistor 29 are included in the fixing unit 6. The thermistor 29 is responsive to the surface temperature of the heat roller 4. The CPU 18 controls the heat roller 4 to preselected temperature in accordance with temperature data received from the thermistor 29 via the I/O controller 19. A communication interface 23 is connected to the CPU 18 via the I/O controller 19 in order to transfer a print command or print signal received from a personal computer to the CPU 18. A control panel 26 is connected to the CPU 18 and allows the operator to select a desired kind of sheets or desired resolution.

Figure 3:
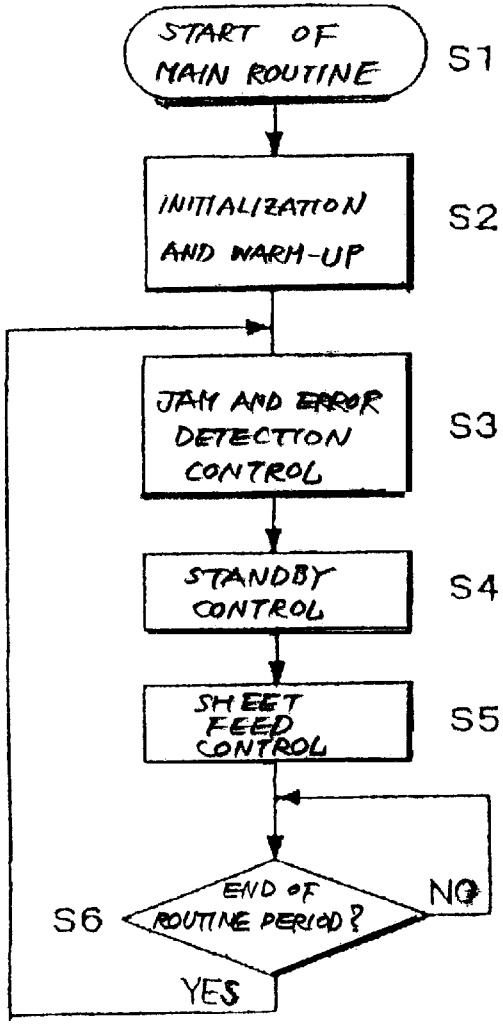
FIG. 3 is a flowchart demonstrating a main routine to be executed by a controller included in the control system of FIG. 2.

FIG. 3 shows a specific main routine to be executed by the controller 27. The main routine to be described is assumed to be executed in a period of the order of as short as 10 milliseconds. During each period, there are executed all of control for error detection, standby control, and sheet feed control. Specifically, the controller 27 starts executing the main routine substantially at the same time as the turn-on of the power switch (step S1). The controller 27 then initializes various parameters for driving the apparatus 1 and controls the warm-up of the apparatus 1 (step S2). Subsequently, the controller 27 executes control for detecting sheet jams around the cassette 8 and on the conveyance path and control for detecting a fixing temperature error, a high-tension voltage control error and so forth (step S3). When the engine enters a standby mode after the warm-up control, the controller 27 executes stand-by control (step or subroutine S4). After the step S4, as soon as the engine enters a sheet feed mode, the controller 27 executes sheet feed control (step or subroutine S5). Thereafter, the controller 27 determines whether or not one period assigned to the main routine has elapsed (step S6). If the answer of the step S6 is positive (YES), the controller 27 again executes the steps S3 through S5. If the answer of the step S6 is negative (NO), the controller 27 repeats the step S6. For example, one period elapses in a preselected period of time (YES, step S6) since the execution of the step S3. For the step S6, use is made of a timer included in the CPU 18.

Figure 4:
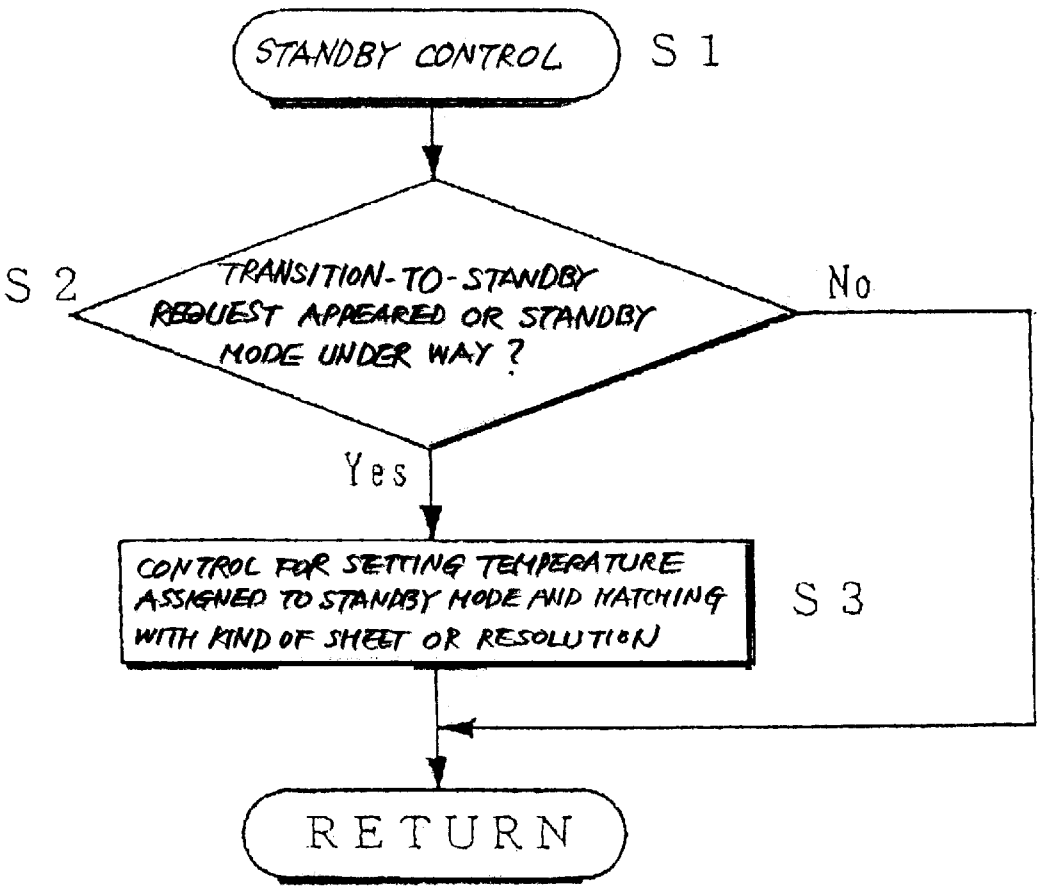
FIGS. 4 through 6 are flowcharts each showing a particular subroutine included in the main routine in detail.

The subroutine S4 will be described specifically with reference to FIG. 4. As shown, the controller 27 starts executing the subroutine S4 (step S1) and then determines whether or not a transition-to-standby request has appeared or whether or not the standby mode is under way (step S2). If the transition-to-standby request has appeared or if the standby mode is under way (YES, step S2), then the controller 27 sets up fixing temperature matching with the kind of a-sheet and resolution in the standby mode (step S3). At this instant, the controller 27 sets up the standby mode before the step S3 if the current mode is not the standby mode. The transition-to-standby request appears after the warm-up operation and after the feed of sheets. If the answer of the step S2 is NO, then the controller 27 ends the subroutine S4, FIG. 3.

Figure 5:
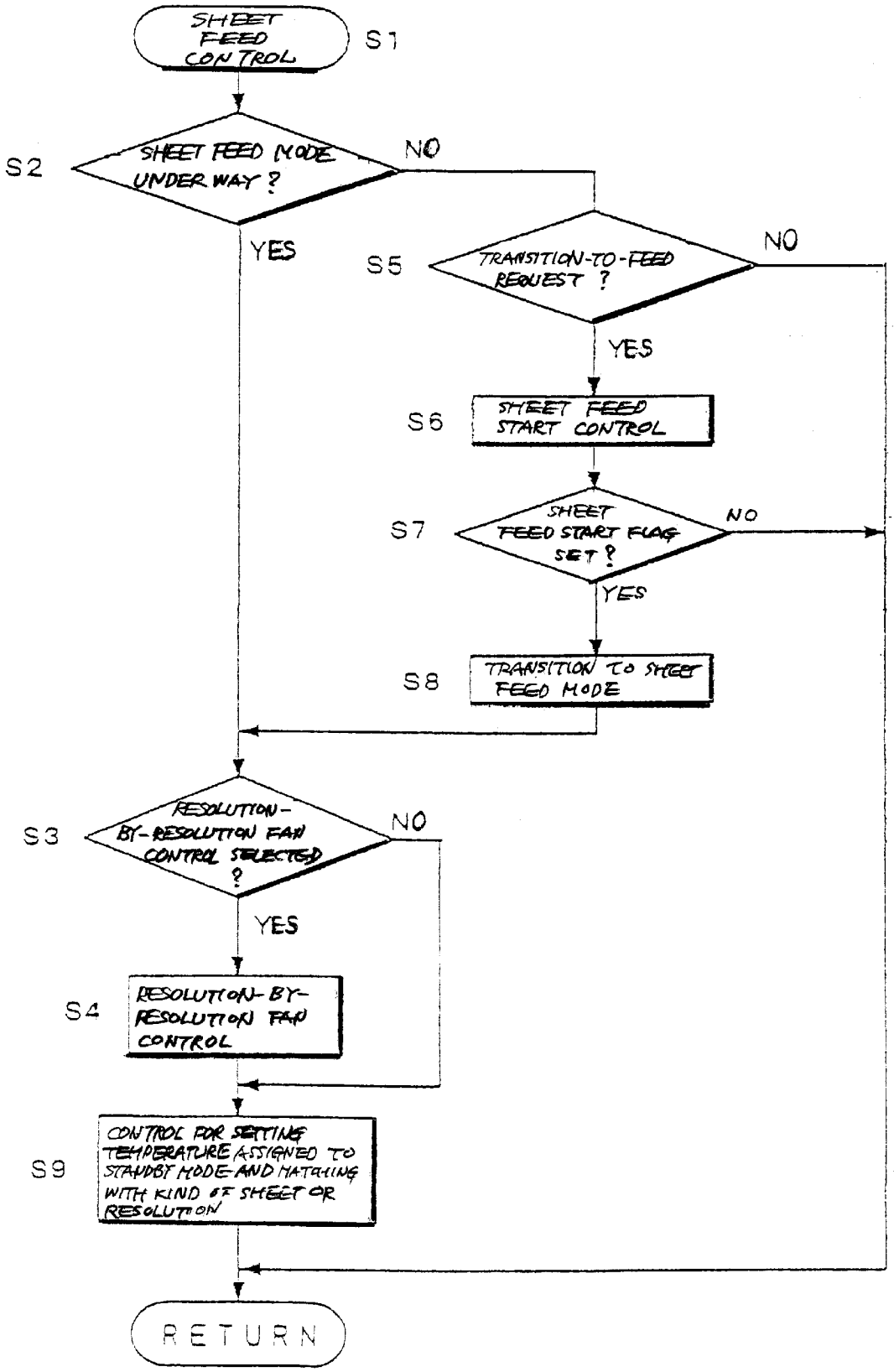

FIG. 5 shows the subroutine S5, FIG. 3, in detail. As shown, the controller 27 starts executing the subroutine S5 (step S1) and then determines whether or not the sheet feed mode has been set up (step S2). If the answer of the step S2 is YES, then the controller 27 determines whether or not to execute resolution-by-resolution fan control (step S3). If the answer of the step S3 is YES, then the controller 27 executes resolution-by-resolution fan control (step S4). On the other hand, if the answer of the step S2 is NO, then the controller 27 determines whether or not a transition-to-feed request has appeared (step S5). If the answer of the step S5 is YES, then the controller 27 executes sheet feed start control (step S6). More specifically, in the step S6, the controller 27 determines whether or not to cause sheet feed to start. If the answer of the step S5 is NO, then the controller 27 ends the subroutine S5, FIG. 3.

After the step S6, the controller 27 determines whether or not a feed start flag is set (step S7). If the answer of the step S7 is YES, then the controller 27 sets up the sheet feed mode (step S8) and then executes the steps S3 and S4. If the answer of the step S7 is NO, then the controller 27 inhibits sheet feed until the engine reaches target temperature. The resolution-by-resolution fan control (step S4) will be described later in detail. The step S4 is followed by a step S9 for controlling the fixing temperature to target temperature matching with the kind of a sheet to be used or resolution. The controller 27 then ends the subroutine step S5, FIG. 3.

Figure 6:
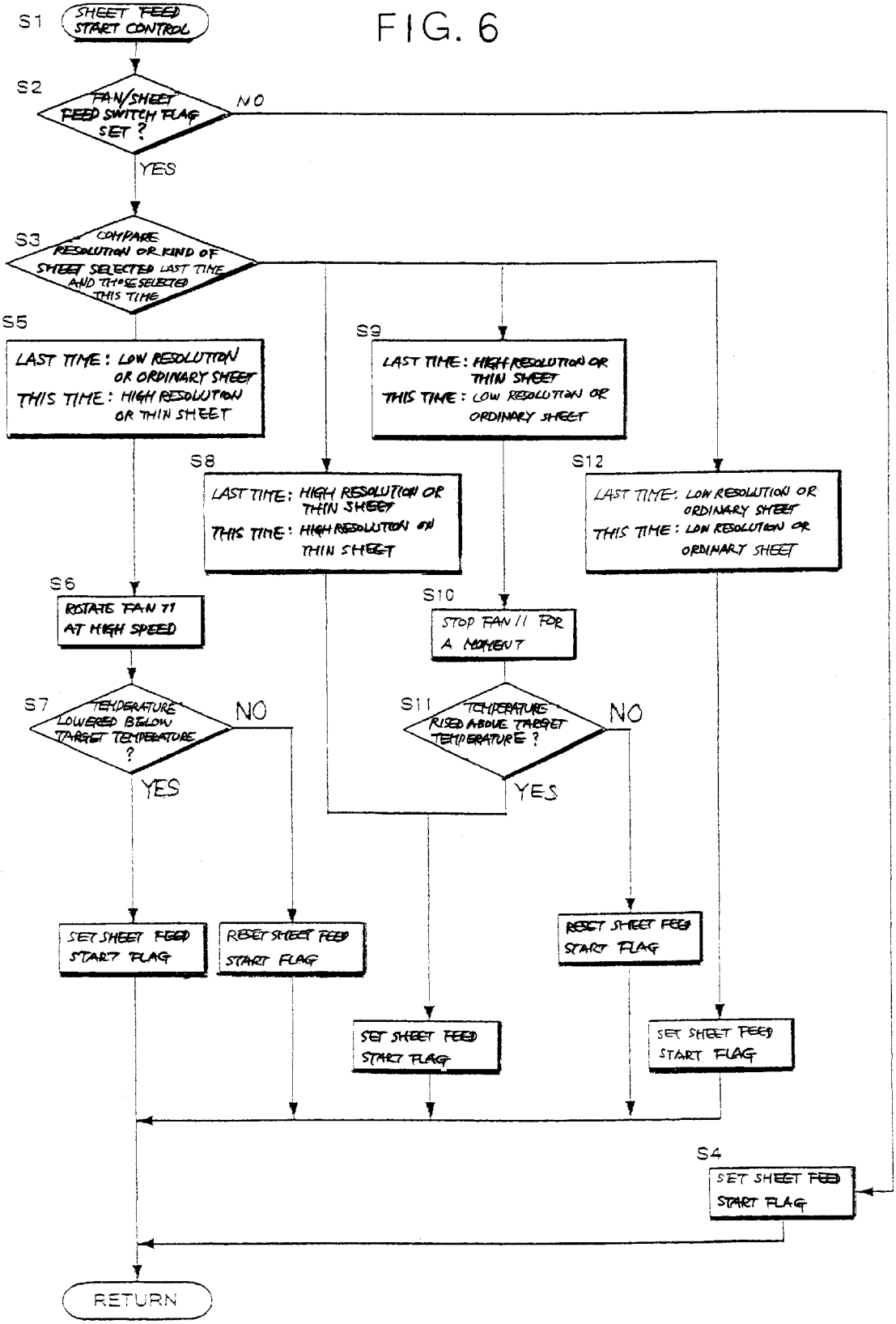

The sheet feed start control (step S6, FIG. 5) will be described hereinafter in detail. Assume that a thin sheet is to be fed after an ordinary sheet fed last time. Then, in the illustrative embodiment, the controller 27 causes the heat discharge fan 11 to rotate at a higher speed than during usual sheet feed for a preselected period of time, thereby rapidly lowering the fixing temperature to preselected one. On the other hand, assume that an ordinary sheet is to be fed after a thin sheet fed last time. Then, the controller 27 stops the rotation of the heat discharge fan 11 in order to raise the fixing temperature as rapidly as possible. Further, assume that high resolution is to be set up by a low linear velocity after low resolution set up by a high linear velocity last time. Then, the controller 27 causes the heat discharge fan 11 to rotate at a higher speed than during usual sheet feed for a preselected period of time, thereby rapidly lowering the fixing temperature. On the other hand, assume that low resolution is to be set up by a high linear velocity after high resolution set up by a low linear velocity last time. Then, the controller 27 stops the rotation of the heat discharge fan 11 in order to raise Reference will be made to FIGS. 6 and 7 for describing the sheet feed start control (step S6, FIG. 5) in detail. As shown in FIG. 6, after the start of the sheet feed start control (step S1), the controller 27 determines whether or not fan/sheet feed switch flag is set (step S2). If the answer of the step S2 is YES, then the controller 27 executes a step S3 that will be described later specifically. If the answer of the step S2 is NO, then the controller 27 unconditionally sets the previously mentioned sheet feed start flag, so that a sheet is fed without regard to resolution or the kind of the sheet (step S4).

In the step S3, the controller 27 compares resolution and the kind of a sheet selected last time and resolution and the kind of a sheet selected this time. As shown in step S5, assume that a low linear velocity, i.e., high resolution is selected in place of a high linear velocity, i.e., low resolution selected last time (condition (4), FIG. 7) or that a thin sheet is selected in place of an ordinary sheet selected last time (condition (1), FIG. 7). Then, the controller 27 causes the heat discharge fan 11 to rotate at a high speed (step S6). It is to be noted that the linear velocity refers to the rotation speed of the drum 2, FIG. 1.

More specifically, by causing the heat discharge fan 11 to rotate at a high speed (step S6), the controller 27 lowers high temperature set last time in matching relation to low resolution or an ordinary sheet. The controller 27 then determines whether or not the fixing temperature has lowered below target temperature (step S7). If the answer of the step S7 is YES, then the controller 27 sets the sheet feed start flag; if otherwise, it resets the sheet feed start flag. This allows sheet feed to start as soon as the fixing temperature lowers below the target temperature. It follows that offset or similar defect is obviated even when the kind of a sheet or resolution is switched.

Assume that resolution selected this time and resolution selected last time both are high or that thin sheets are selected this time and last time (step S8). Then, the controller 27 unconditionally sets the sheet feed start flag in order to start sheet feed immediately. On the other hand, assume that high resolution is selected in place of low resolution (condition (3), FIG. 7) or that an ordinary sheet is selected in place of a thin sheet (condition (2), FIG. 7) (step S9). Then, the controller 27 stops the rotation of the heat discharge fan 11 (step S10) in order to raise the low fixing temperature set for high resolution or the thin sheet last time. In this manner, when the kind of a sheet or resolution is varied, the illustrative embodiment selectively lowers or raises It the fixing temperature by causing the heat discharge fan 11 to rotate at a high speed or causing it to stop rotating.

After the step S10, the controller 27 determines whether or not the fixing temperature has risen above target temperature (step S11). If the answer of the step S11 is YES, then the controller 27 sets the sheet feed start flag; if otherwise, the controller 27 resets the sheet feed start flag. In this manner, the controller 27 can start sheet feed as soon as the fixing temperature rises above the target temperature, obviating defective fixation or similar trouble. Further, assume that resolution selected this time and resolution selected last time both are high or that ordinary sheets are selected this time and last time (step S12). Then, the controller 27 unconditionally sets the sheet feed start flag in order to start sheet feed immediately. The sheet feed start control ends after the sheet feed start flag has been set, as stated above.

In the case of a sheet thicker than an ordinary sheet, for example, fixing temperature higher than one assigned to the ordinary sheet is set. Therefore, when such a thick sheet is selected in place of a thin sheet, the controller 27 stops the rotation of the heat discharge fan 11. Further, when a thick sheet is selected in place of an ordinary sheet, the controller 27 maintains the ordinary rotation speed of the heat discharge fan 11.

As shown in FIG. 7, after the feed of a sheet, the controller 27 stops the rotation of the heat discharge fan 11 in the conditions (1) and (4) set on the control panel 26, FIG. 2, but does not stop it in the conditions (2) and (3). More specifically, in the conditions (1) and (4), the controller 27 stops the rotation of the heat discharge fan 11 just after the drive of the registration roller 10 and then resumes it just after the leading edge of a sheet has moved away from the outlet sensor 12. In the conditions (2) and (3), the controller 27 does not stop the rotation of the heat discharge fan 11 after the start of sheet feed, but continues the usual rotation of the fan 11.

Further, the illustrative embodiment executes unique processing when the operation mode is switched from the sheet feed mode to the standby mode, as will be described herein after. Assume that the heat discharge fan 11 is rotating at the usual speed when the sheet feed mode is replaced with the standby mode, that the fixing temperature in the standby mode is T in the event of replacement of the standby mode with the sheet feed mode, and that the fixing temperature in the sheet feed mode is t. Further, assume that when the temperature T is higher than the temperature t, i.e., when the fixing temperature is lowered at the time of transition from the standby mode to the sheet feed mode, the allowable temperature difference is $t_{down}$. In addition, assume that that when the temperature T is lower than the temperature t, i.e., when the fixing temperature is to be raised at the time of transition from the standby mode to the sheet feed mode, an allowable temperature difference is $t_{up}$. Then, when the difference $T-t_{down}$ is greater than t, the controller 27 causes the heat discharge fan 11 to rotate at a higher speed than during usual sheet feed. When the difference $T-t_{down}$ is equal to or smaller than t, which is in turn equal to or smaller than a sum $T+T_{up}$ the controller 27 causes the heat discharge fan 11 to rotate at the usual speed. Further, when the sum $T+t_{up}$ is smaller than t, the controller 27 causes the heat discharge fan 11 to stop rotating for a moment. Such unique processing will be described more specifically with reference to FIGS. 7, 8A and 8B.

FIGS. 8A and 8B show experimental results showing a relation between the kind of sheets and resolution and the fixing temperature in the sheet feed mode and standby mode, respectively. It should be noted that temperatures (° C.) shown in FIGS. 8A and 8B are only illustrative, and that $t_{down}$ and $t_{up}$ are selected to be 10° C. and 30° C., respectively.

In conditions (5) and (7) shown in FIG. 7, the controller 27 causes the heat discharge fan 11 to stop rotating up to the start of sheet feed on the basis of the temperature data shown in FIGS. 8A and 8B. In a condition (6), the controller 27 causes the heat discharge fan 11 to rotate at a high speed for a preselected period of time up to the start of sheet feed. In a condition (8), the controller 27 causes the heat discharge fan 11 to rotate at the usual speed up to the start of sheet feed. Further, in the conditions (5), (6) and (8), the controller 27 causes the heat discharge fan 11 to stop rotating after the start of sheet feed. In addition, in the condition (7), the controller 27 does not cause the heat discharge fan 11 to stop rotating after the start of sheet feed.

The resolution-by-resolution fan control will be described with reference to FIG. 9. In the illustrative embodiment, when a low linear velocity, i.e., high resolution or a thin sheet is selected, the controller 27 can cause the heat discharge fan 11 to stop rotating just after the start of drive of the registration roller pair 10 during sheet feed. Also, the controller 27 can cause the heat discharge fan 11 to again start rotating at the usual speed just after the leading edge of a sheet being conveyed has moved away from the outlet sensor 12.

Figure 9:
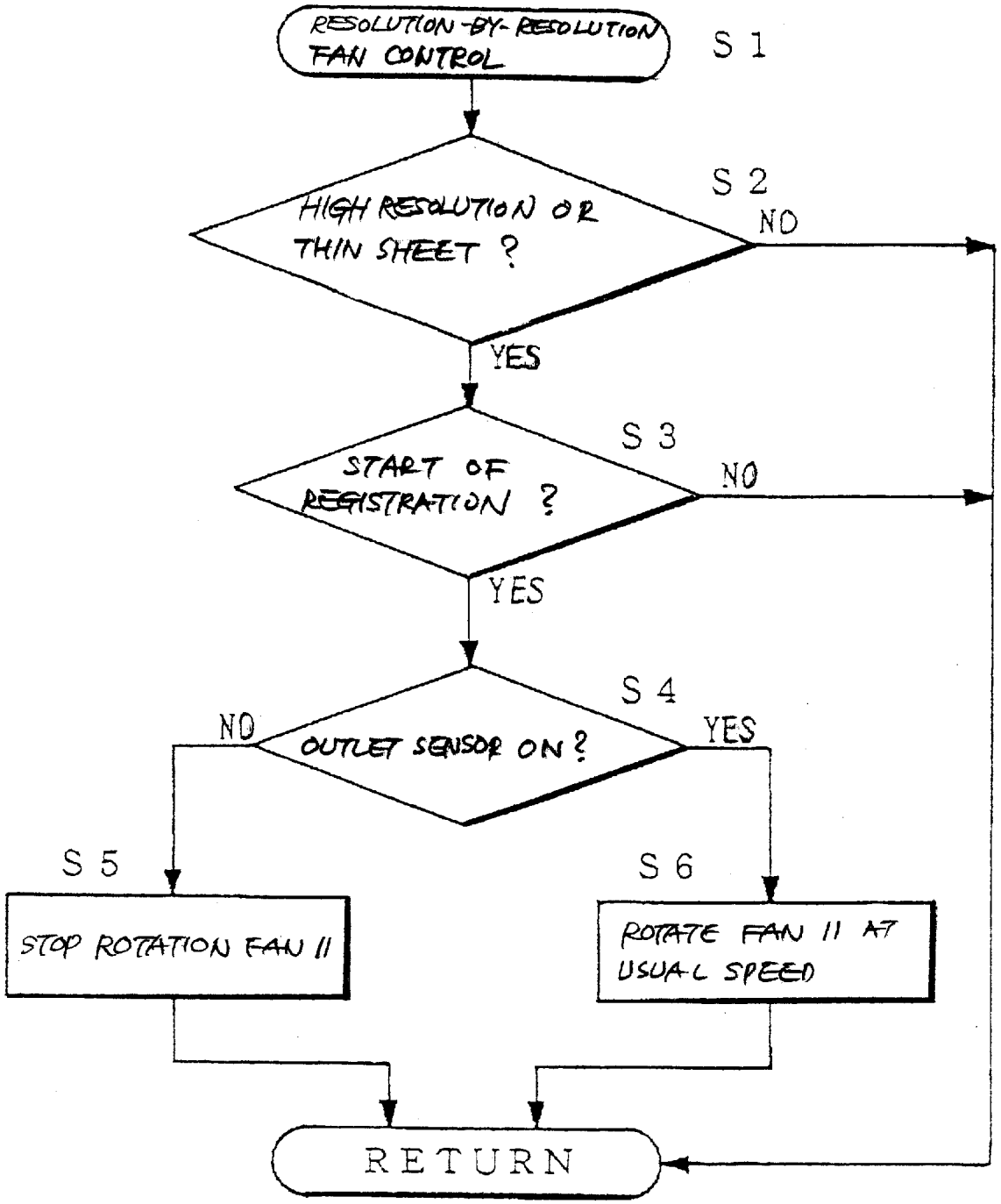
FIG. 9 is a flowchart demonstrating resolution-bay-resolution fan control practicable with the illustrative embodiment.

Specifically, as shown in FIG. 9, the controller 27 starts executing the resolution-by-resolution fan control (step S1) and then determines whether or not resolution as high as, e.g., 1,200 dpi is selected or whether or not a thin sheet is selected (step S2). If the high resolution is selected or if a thin sheet is selected (YES, step 2), then the controller 27 executes a step S3 for determining whether or not the registration roller pair 10 has started being driven. If the answer of the step S3 is YES, then the controller 27 determines whether or not the outlet sensor 12 has turned on (step S4). If the answer of the step S3 is NO, then the controller 27 once ends the resolution-by-resolution fan control (RETURN). More specifically, the controller 27 again executes the above control in the next routine and, because the answer of the step S2 is YES in the previous routine, again executes the step S3. The controller 27 repeats such a sequence of steps in the period of the routine until the registration roller pair 10 starts being driven.

If the answer of the step S4 is NO, then the controller 27 causes the heat discharge fan 11 to stop rotating (step S5). If the answer of the step S4 is YES, then the controller 27 causes the heat discharge fan 11 to rotate at the usual speed (step S6). In this manner, the heat discharge fan 11 rotates at the usual speed until the registration roller pair 10 starts rotating, stops rotating from the time when the registration roller pair 10 starts rotating to the time when the leading edge of the sheet moves away from the outlet sensor 12, and again starts rotating at the usual speed after the leading edge of the sheet has moved away from the sensor 12. After the step S5 or S6, the controller 27 ends the control.

In summary, it will be seen that the present invention provides an image forming apparatus capable of obviating the creasing of a sheet ascribable to excessive heat during fixation, reducing a waiting time up to sheet refeed, and obviating defective fixation ascribable to defective heating and thereby enhancing image quality. This is also true even when the kind of a sheet to be used or resolution is varied. In addition, the apparatus of the present invention is capable of executing particular control for, e.g., each special sheet that needs a particular fixing condition.

Various modifications will become possible for those skilled in the art after receiving the teachings of the present disclosure without departing from the scope thereof.

What is claimed is:

1. An image forming apparatus comprising:

an image forming section including at least a photoconductive element, a fixing unit, a developing unit, and a heat discharge fan; and a controller for selectively stopping a rotation of said heat discharge fan for a moment or controlling a rotation speed of said heat discharge fan, and for selectively raising or lowering a fixing temperature in each of a sheet feed mode and a standby mode, wherein said controller causes, when a thin sheet is to be fed after an ordinary sheet fed last time, sheet feed to wait until the fixing temperature has been lowered, rotates said heat discharge fan at a higher speed than during sheet feed for a preselected period of time to thereby rapidly lower said fixing temperature to a preselected temperature or stops, when an ordinary sheet is to be fed after a thin sheet fed last time, the rotation of said heat discharge fan to thereby raise said fixing temperature as rapidly as possible, and wherein when said heat discharge fan is rotating at a usual speed when the sheet feed mode is replaced with the standby mode, the fixing temperature in said standby mode is T in the event of a replacement of said standby mode with said sheet feed mode, said fixing temperature in said sheet feed mode is t, when said temperature T is higher than said temperature t occurring when said fixing temperature is lowered at the time of transition from said standby mode to said sheet feed mode, an allowable temperature difference is $t_{down}$, and when said temperature T is lower than said temperature t occurring when said fixing temperature is to be raised at the time of transition from said standby mode to said sheet feed mode, an allowable temperature difference is $t_{up}$, then said controller rotates said heat discharge fan at a higher speed than during usual sheet feed when a difference $T-t_{down}$ is greater than t, or rotates said heat discharge fan at a usual speed when said difference $T-t_{down}$ is equal to or smaller than t, which is in turn equal to or smaller than a sum $T+t_{up}$, or stops the rotation of said heat discharge fan for a moment when said sum $T+t_{up}$ is smaller than t.

2. The apparatus as claimed in claim 1, further comprising a switching section for allowing, even when the fixing temperature differs from sheet feed effected last time to sheet feed to be effected this time, an operator of said apparatus to determine whether or not to use control over said heat discharge fan.

3. An image forming apparatus comprising:

an image forming section including at least a photoconductive element selectively rotatable at two different linear velocities each being assigned to a particular resolution, a fixing unit, a developing unit, and a heat discharge fan; and a controller for selectively stopping a rotation of said heat discharge fan for a moment or controlling a rotation speed of said heat discharge fan in accordance with the resolution, and for selectively raising or lowering a fixing temperature in each of a sheet feed mode and a standby mode, wherein said controller causes, when a lower linear speed that implements a higher resolution is selected after a higher linear speed that implements a lower resolution selected last time, sheet feed to wait until the fixing temperature has been lowered, rotates said heat discharge fan at a higher speed than during sheet feed for a preselected period of time to thereby rapidly lower said fixing temperature to a preselected temperature or stops, when said higher linear speed is selected after said lower linear speed selected last time, the rotation of said heat discharge fan to thereby raise said fixing temperature as rapidly as possible, and wherein when said heat discharge fan is rotating at a usual speed when the sheet feed mode is replaced with the standby mode, that the fixing temperature in said standby mode is T in the event of a replacement of said standby mode with said sheet feed mode, said fixing temperature in said sheet feed mode is t, when said temperature T is higher than said temperature t occurring when said fixing temperature is lowered at the time of transition from said standby mode to said sheet feed mode, an allowable temperature difference is $t_{down}$, and when said temperature T is lower than said temperature t occurring when said fixing temperature is to be raised at the time of transition from said standby mode to said sheet feed mode, an allowable temperature difference is $t_{up}$, then said controller rotates said heat discharge fan at a higher speed than during usual sheet feed when a difference $T-t_{down}$, is greater than t, or rotates said heat discharge fan at a usual speed when said difference $T-t_{down}$ is equal to or smaller than t, which is in turn equal to or smaller than a sum $T+t_{up}$, or stops the rotation of said heat discharge fan for a moment when said sum $T+t_{up}$ is smaller than t.

4. The apparatus as claimed in claim 3, further comprising a switching section for allowing, even when the fixing temperature differs from sheet feed effected last time to sheet feed to be effected this time, an operator of said apparatus to determine whether or not to use control over said heat discharge fan.

5. An image forming apparatus comprising:

an image forming section including at least a photoconductive element selectively rotatable at two different linear velocities each being assigned to a particular resolution, a fixing unit, a developing unit, and a heat discharge fan; and a controller for varying a fixing temperature in a sheet feed mode and a fixing temperature in a standby mode, and for selectively stopping a rotation of said heat discharge fan for a moment or varying a rotation speed of said heat discharge fan in accordance with said fixing temperature, wherein when said heat discharge fan is rotating at a usual speed when the sheet feed mode is replaced with the standby mode, the fixing temperature in said standby mode is T in the event of a replacement of said standby mode with said sheet feed mode, said fixing temperature in said sheet feed mode is t, when said temperature T is higher than said temperature t occurring when said fixing temperature is lowered at the time of transition from said standby mode to said sheet feed mode, an allowable temperature difference is $t_{down}$, and when said temperature T is lower than said temperature t occurring when said fixing temperature is to be raised at the time of transition from said standby mode to said sheet feed mode, an allowable temperature difference is $t_{up}$, then said controller rotates said heat discharge fan at a higher speed than during usual sheet feed when a difference $T-t_{down}$, is greater than t, or rotates said heat discharge fan at a usual speed when said difference $T-t_{down}$ is equal to or smaller than t, which is in turn equal to or smaller than a sum $T-t_{up}$, or stops the rotation of said heat discharge fan for a moment when said sum $T+t_{up}$ is smaller than t.

6. The apparatus as claimed in claim 5, further comprising a switching section for allowing, even when the fixing temperature differs from sheet feed effected last time to sheet feed to be effected this time, an operator of said apparatus to determine whether or not to use control over said heat discharge fan.

7. An image forming apparatus comprising:

an image forming section including at least a photoconductive element, a fixing unit, a developing unit, a heat discharge fan, and an outlet sensor responsive to a discharge of a sheet; and a controller for stopping, when said photoconductive element is rotated at a low linear velocity for implementing a high resolution or when a thin sheet is used, a rotation of said heat discharge fan just after a start of drive of a registration roller pair during sheet feed, and again rotating said heat discharge fan at a usual speed just after a leading edge of the sheet has moved away from said outlet sensor, wherein when said heat discharge fan is rotating at a usual speed when the sheet feed mode is replaced with the standby mode, the fixing temperature in said standby mode is T in the event of a replacement of said standby mode with said sheet feed mode, said fixing temperature in said sheet feed mode is t, when said temperature T is higher than said temperature t occurring when said fixing temperature is lowered at the time of transition from said standby mode to said sheet feed mode, an allowable temperature difference is $t_{down}$, and when said temperature T is lower than said temperature t occurring when said fixing temperature is to be raised at the time of transition from said standby mode to said sheet feed mode, an allowable temperature difference is $t_{up}$, then said controller rotates said heat discharge fan at a higher speed than during usual sheet feed when a difference $T-t_{down}$ is greater than t, or rotates said heat discharge fan at a usual speed when said difference $T-t_{down}$ is equal to or smaller than t, which is in turn equal to or smaller than a sum $T+t_{up}$, or stops the rotation of said heat discharge fan for a moment when said sum $T+t_{up}$ is smaller than t.

8. The apparatus as claimed in claim 7, further comprising a switching section for allowing, even when the fixing temperature differs from sheet feed effected last time to sheet feed to be effected this time, an operator of said apparatus to determine whether or not to use control over said heat discharge fan.

* * * * *